US006081683A

United States Patent [19]

Miyasaka et al.

[11] Patent Number: 6,081,683

[45] Date of Patent: Jun. 27, 2000

[54] COLOR ELECTROPHOTOGRAPHIC APPARATUS WITH OBLIQUELY ARRANGED PHOTOSENSITIVE BELT

[75] Inventors: Toru Miyasaka; Toshiya Satoh; Hiroyuki Tadokoro; Kazuhiro Wakamatsu, all of Hitachi; Masahiko Saito, Kitaibaraki, all of Japan

[73] Assignee: Hitachi, Ltd., Tokyo, Japan

[21] Appl. No.: 08/642,443

[22] Filed: May 3, 1996

[30] Foreign Application Priority Data

May 10, 1995 [JP] Japan ..... 7-111519

[51] Int. Cl.[7] ..... G03G 15/06

[52] U.S. Cl. ..... 399/228; 399/302

[58] Field of Search ..... 399/228, 231, 399/302, 308

[56] References Cited

U.S. PATENT DOCUMENTS

| | | | |
|---|---|---|---|
| 4,618,243 | 10/1986 | Knapp | 399/231 |
| 4,690,096 | 9/1987 | Hacknauer et al. | 399/228 X |
| 4,710,016 | 12/1987 | Waatanabe | 399/228 |
| 4,891,674 | 1/1990 | Seyfried | 399/228 |
| 5,027,158 | 6/1991 | Tompkins et al. | 399/302 X |
| 5,361,126 | 11/1994 | Loonen et al. | 399/308 |
| 5,365,318 | 11/1994 | Hiraoka et al. | 399/281 |
| 5,444,515 | 8/1995 | Haneda et al. | 399/223 X |
| 5,541,720 | 7/1996 | Haneda | 399/228 |
| 5,666,599 | 9/1997 | Miyasaka et al. | 399/302 X |

FOREIGN PATENT DOCUMENTS

| | | |
|---|---|---|
| 1-259381 | 10/1989 | Japan . |
| 2-116868 | 5/1990 | Japan . |
| 6-122234 | 5/1994 | Japan . |
| 7-104546 | 4/1995 | Japan . |

*Primary Examiner*—Fred L. Braun
*Attorney, Agent, or Firm*—Antonelli, Terry, Stout & Kraus, LLP

[57] ABSTRACT

A color electrophotographic apparatus includes a photosensitive belt arranged obliquely, and a plurality of developing machines arranged on one side of the photosensitive belt in a stacked manner so as to be displaced from one another in a horizontal direction. The photosensitive belt is movable from below to above in a direction opposite to a direction of gravity when in a developing position. The developing machines include a non-magnetic, one component contact developing system having a developing roll for adhering toner on the photosensitive belt and a blade disposed below the developing roll for controlling an amount of toner adhering to the developing roll.

12 Claims, 9 Drawing Sheets

COLOR ELECTROPHOTOGRAPHIC APPARATUS WITH OBLIQUELY ARRANGED PHOTOSENSITIVE BELT

BACKGROUND OF THE INVENTION

This invention relates generally to an apparatus for recording a color image, and more particularly to a color electrophotographic apparatus utilizing an electrophotographic process.

There are known various methods of recording a color image in accordance with image information from a computer or the like. Among these methods, one utilizing electrophotography is effective in recording a color image of a high picture quality at relatively high speed. In the color image recording utilizing an electrophotographic method, yellow, magenta, cyan and black toner images are formed on a photosensitive member (recording member), and the thus formed toner images are combined together in a superimposed manner on paper or an intermediate transfer member, thereby forming a multicolor image. This electrophotographic method requires many imaging processes, and therefore has a disadvantage that the apparatus is complicated in construction, can not be easily handled, and tends to have a large overall size. Generally, four developing machines, when arranged around one photosensitive drum, are different in construction from one another, and therefore four kinds of developing machines are needed, thus complicating the construction of the apparatus, and besides the diameter of the photosensitive drum is increased. Therefore, there has been proposed a method in which a photosensitive drum having a relatively small diameter is used, and four developing machines are switched (that is, sequentially operated) by the use of a mechanism for sliding or rotating the developing machine. In this method, however, the mechanism for moving the developing machines is required, and therefore the apparatus is complicated in construction, and also can not be handled fully satisfactorily.

On the other hand, there has been proposed a method in which a photosensitive belt is used, thereby providing a flat portion on the photosensitive member, and a plurality of (usually, three or four) developing machines are arranged over this flat portion. For example, Japanese Patent Unexamined Publication No. 2-213884 discloses a color electrophotographic apparatus in which three developing machines are arranged over an upper surface of a photosensitive belt extended horizontally, and toner images formed on the photosensitive belt are transferred onto an intermediate transfer belt in an superimposed manner. Japanese Patent Unexamined Publication No. 5-503377 discloses another such example in which developing machines are arranged utilizing a flat portion of a photosensitive belt. In this construction, the developing machines are arranged below the photosensitive member. There is also disclosed a construction in which a photosensitive belt is extended in a vertical direction, and developing machines are arranged in a stacked manner on one side of the photosensitive member. In such a conventional construction, the developing machines are arranged on one side of the vertically-extended photosensitive member in the form of a belt.

In the above methods utilizing the photosensitive belt, it is somewhat difficult to handle the belt, but since the developing machines do not need to be moved extensively, a switching mechanism for them is simplified, and therefore with such a construction, a full-color laser beam printer of a desk-top size, which can be relatively easily formed into a small size, can be achieved.

However, even these methods still have the following problems. In these methods, the developing machines are arranged parallel to the photosensitive member. Therefore, the toner in the developing machine, located at an upstream side of the photosensitive member, is liable to be included or introduced into the developing machine located at a downstream side of the photosensitive belt.

In the method as disclosed in Japanese Patent Unexamined Publication No. 2-213884 in which a plurality of developing machines are arranged above a photosensitive belt, the developing machines are arranged above the upper surface of the photosensitive belt, and therefore there is encountered a problem that toners and a carrier are liable to be spilt on the photosensitive belt. In the construction disclosed in Japanese Patent Unexamined Publication No. 2-213884, the photosensitive member and the intermediate transfer member are both in the form of a belt, and therefore it is difficult to properly register the two belts with respect to each other because of expansion and contraction of the belts, offset of the belts, and so on, and therefore when the photosensitive member and the intermediate transfer member are rotated several times so as to form a color image, it is difficult to precisely form the images of the respective colors.

In the construction as disclosed in Japanese Patent Unexamined Publication No. 5-503377 in which a plurality of developing machines are arranged below a photosensitive belt, toner and carrier deposited on the photosensitive belt are liable to be introduced into the downstream-side developing machines which are not effecting a developing operation. And besides, since it is necessary to feed a developing agent in the developing machine upwardly against the gravity, the developing machines are complicated in construction. Particularly when the developing machines are of the two-component developing type requiring an agitating chamber in which the toner and the carrier are agitated, the toner must be circulated between the agitating chamber and a developing roll. Therefore, in the developing machine located either above or below the photosensitive member, the toner must be fed against the gravity, and in either case the developing machines are increased in size, and are complicated in construction.

On the other hand, in the construction as disclosed in Japanese Patent Unexamined Publication No. 4-268581 in which a photosensitive belt is extended in a vertical direction, and developing machines are arranged in a stacked manner on one side of the photosensitive member, there is a less flow of developing agents against the gravity as compared with the type of developing machines which effect a developing operation from the upper side or the lower side of the photosensitive member, and therefore generally, the developing machines can be easily formed into a small size. Even in this construction, however, there is encountered a problem that when an electrostatic latent image on the photosensitive member is to be developed, the toners, spilt from the elevated developing machines, are liable to be introduced into the low developing machines.

SUMMARY OF THE INVENTION

It is an object of this invention to provide a small-size color electrophotographic apparatus including a photosensitive belt which can reduce the overall size of the apparatus, in which toners are prevented from being included or introduced from one color developing machine into another color developing machine.

To achieve the above object, in the present invention, a photosensitive belt is extended obliquely relative to a direction of the gravity, and a plurality of developing machines are stacked together adjacent to one flat side surface of the photosensitive belt moving upwardly. The photosensitive belt is so arranged that the upwardly-moving flat side surface thereof is disposed above the other downwardly-moving flat side surface.

In the present invention, the developing machines, which are elongate in a horizontal direction, are stacked together adjacent to one side surface of the obliquely-extending photosensitive belt. Therefore, there is a less flow of developing agents against the gravity in the developing machine as compared with the type of developing machine which effects a developing operation from the upper side or the lower side of the photosensitive member, and the developing machines can be easily formed into a compact, thin design. Since the developing machines are arranged in a plane, in which the photosensitive belt moves upwardly in the direction opposite to the direction of the gravity, toners and other agents, spilt from the developing machines, are less liable to move toward the upstream-side developing machines and also to the downstream-side developing machines. Therefore, the toner in one developing machine is hard to be mixed with the toner in the other developing machines. Since the plurality of developing machines are arranged above the upper flat side of the photosensitive belt, the toner, forming an image, will not drop to be introduced into the downstream-side developing machine.

DESCRIPTION OF THE PREFERRED EMBODIMENTS

Figure 1:
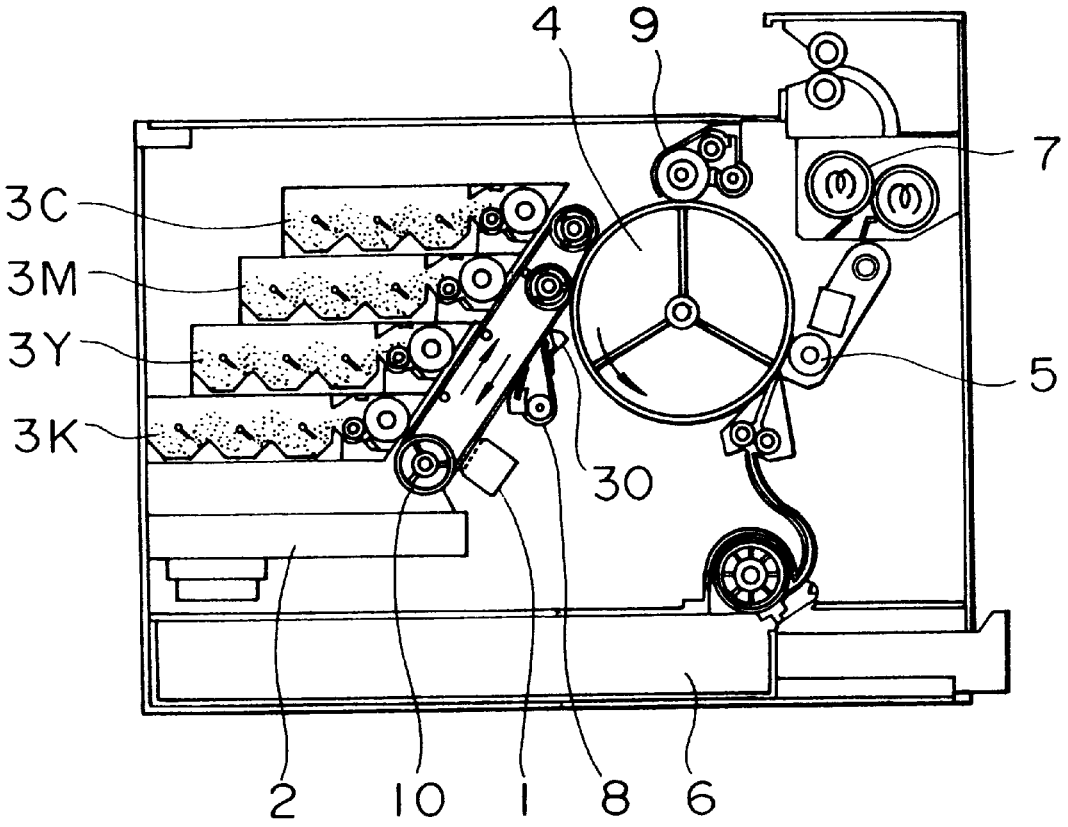
FIG. 1 is a view showing an overall construction of a small-size color electrophotographic apparatus of the present invention.

FIG. 1 is a view showing the construction of one preferred embodiment of a color electrophotographic apparatus of the present invention. The operation of each part of this apparatus, effected when recording a color image, will be first described briefly. This apparatus comprises a photosensitive belt unit 10, and an intermediate transfer drum 4. First, uniform charging (electrification) is effected on the rotating photosensitive member by a static charger 1. Then, laser beam exposure is effected by a laser exposure device 2 in accordance with a yellow image pattern, thereby forming an electrostatic latent image. This electrostatic latent image is developed by a yellow developing machine 3Y, and the thus developed image is transferred to the intermediate transfer drum 4.

After the transfer, the surface of the photosensitive belt is destaticized by an erase lamp 30, and is cleaned by a photosensitive member cleaner 8 of the blade type. The photosensitive member cleaner 8 has a waste toner box, and waste toners, collected by the cleaning operation, are recovered in this waste toner box.

Then, the photosensitive member is again electrically charged, and then exposure is effected in accordance with a magenta image pattern, so that a magenta image is formed by a magenta developing machine 3M. The magenta image is transferred to the intermediate transfer drum 4 in superimposed relation to the precedingly-formed yellow image.

According to the same procedure, a cyan image and a black image are sequentially formed and transferred, so that a multicolor image, composed of the images of four colors (i.e., yellow, magenta, cyan and black colors), is formed on the intermediate transfer drum 4. During the formation of these images, a transfer mechanism 5, comprising an intermediate transfer member cleaner 9, a transfer roller and a static eliminator arranged about the outer periphery of the intermediate transfer drum 4, is held in a non-contact, stand-by (inoperative) condition. Then, a paper sheet is picked up from a paper tray 6, and the four-color image on the intermediate transfer drum 4 is transferred to the paper sheet at a time. After the transfer, the paper sheet is destaticized, is separated from the intermediate transfer drum 4, and is heated by a fixing device 7, so that the toners of four colors are mixed together, and are fused onto the paper sheet, thus completing the full-color image recording. After the toner images are transferred from the intermediate transfer drum 4 to the paper sheet, the residual toners are removed by the intermediate transfer member cleaner 9 for cleaning purposes. The waste toners, collected by the intermediate transfer member cleaner 9, are recovered in the waste toner box of the photosensitive member cleaner 8 provided adjacent to the photosensitive belt.

Electrophotography is capable of recording an image of high quality, but requires many imaging processes, and therefore an apparatus for recording a full-color image is liable to have a large size and to be complicated in construction. In one known method of recording a full-color image utilizing electrophotography, developing machines are switched over to one another by a slide mechanism and a rotating mechanism. However, this method requires a complicated developing machine-switching mechanism.

On the other hand, there has been proposed a method in which a photosensitive belt is used, thereby providing a flat portion on a photosensitive member, and a plurality of developing machine are arranged over this flat portion. In such a method, the developing machines do not need to be moved extensively to be switched, and therefore the mechanism can be relatively simplified, and besides since it is not necessary to provide a space for the movement of the developing machines, there is an advantage that the apparatus can be of a small size.

For example, there is known a color electrophotographic apparatus in which three developing machines are arranged over an upper surface of a photosensitive belt extended horizontally, and toner images, formed on the photosensitive belt, are transferred to an intermediate transfer belt in a superimposed manner. This method has a disadvantage that the toners are liable to drop onto the photosensitive belt since the photosensitive belt is disposed below the developing machines.

Figure 2:
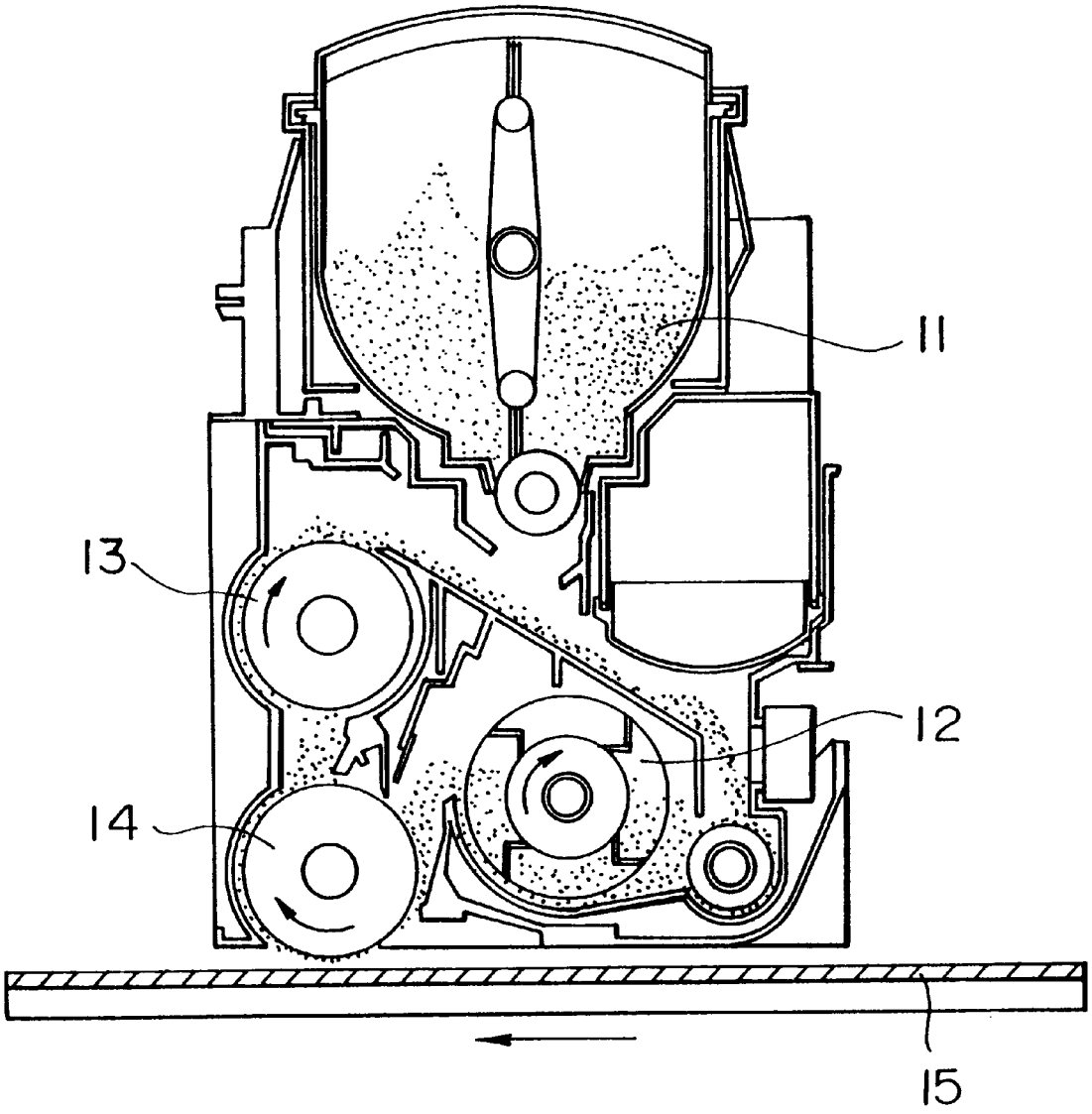
FIG. 2 is a view showing an example of a developing machine which effects a developing operation from an upper side of a photosensitive belt.

FIG. 2 shows one example of developing machine which effects a developing operation from above a photosensitive belt. The developing machine shown in this Figure is of the two-component type, in which a toner must be circulated between an agitating roll 12 (which agitate and mix the toner and a carrier) and a developing roll 14. In this developing machine located above the photosensitive belt 15, a magnet roll 13 is provided above the developing roll 14 for feeding the toner upwardly so as to return the toner on the developing roll 14 to an agitating chamber. Thus, the developing machine, located above the photosensitive belt 15, can not easily be reduced in size, and can not easily be simplified in construction.

In a construction in which developing machines are arranged below a photosensitive belt, toners will not drop onto the photosensitive belt. In this case, however, a toner must be fed upwardly to a developing roll against the gravity, and therefore such developing machine can not be easily reduced in size, and can not be easily simplified in construction, as in the developing machine shown in FIG. 2.

On the other hand, in a construction in which a photosensitive belt is extended in a vertical direction, and developing machines are stacked together on one side of the photosensitive belt, toners do not need to be fed fairly against the gravity, and therefore this construction has advantages that the developing machines can be easily formed into a thin design, and that the toners are less liable to drop onto the photosensitive belt.

Figure 3:
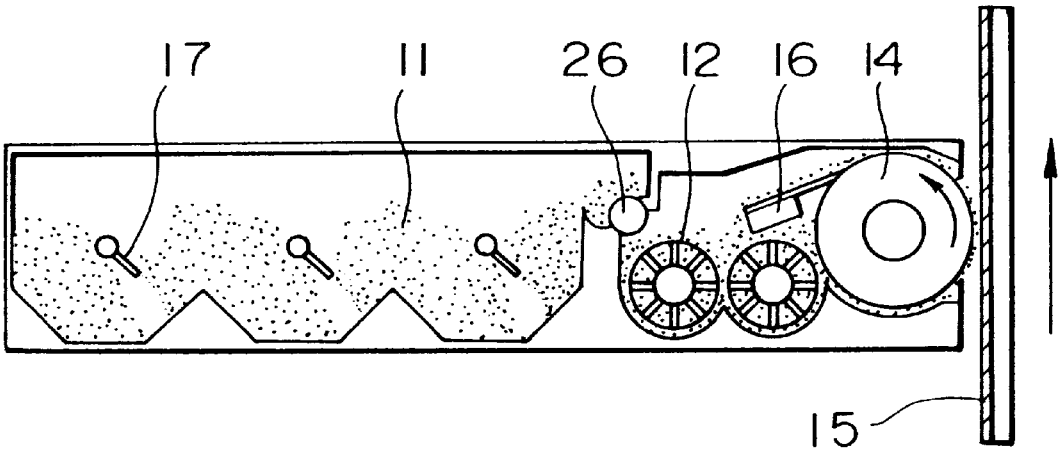
FIG. 3 is a view showing a two-component type developing machine which effects a developing operation from one side of a photosensitive belt.

FIG. 3 shows one example of a two-component developing machine which effects a developing operation from one side of a photosensitive belt. In this developing machine, toner is circulated between a developing roll 14 and an agitating chamber provided adjacent to this developing roll 14. More specifically, the toner in a toner-containing chamber 11 is fed toward an agitating-developing chamber by scraping blades 17 to be supplied into the agitating-developing chamber by a sponge roll 26, and then is agitated and mixed with a carrier by agitating rolls 12 to be frictionally electrified to be then supplied to the developing roll 14. The residual toner on the developing roll 14 which has not been used for the developing is removed from this roll 14 by a scraper blade 16 to be returned to the agitating chamber. A toner concentration sensor is provided in the agitating roll 12, and supplying of the toner from the toner-containing chamber 11 is controlled in accordance with a detected value of the toner concentration sensor. The photosensitive belt 15 moves upwardly, and the developing roll 14 within the developing chamber is also rotated in a counterclockwise direction as indicated by an arrow. By thus rotating the developing roll 14 in this direction, the dropping of the toner can be considerably prevented.

In order to decrease the overall size of the apparatus, the length of the photosensitive belt needs to be reduced, and to achieve this, it is also necessary to reduce the thickness of the developing machine. In view of these, it is advantageous to arrange the developing machines on one side of the photosensitive belt so that the developing machines can be easily formed into a small-size, simple construction. A non-magnetic one-component developing machine is better known as a compact, simple developing machine than the two-component developing machine.

Figure 4:
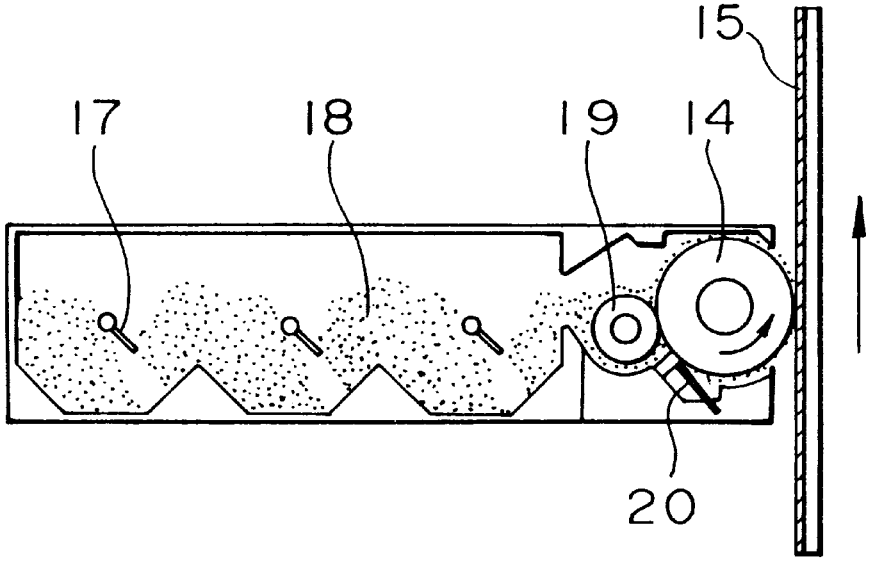
FIG. 4 is a view showing a non-magnetic one-component developing machine which effects a developing operation from one side of a photosensitive belt.

FIG. 4 shows one example of a non-magnetic one-component developing machine which effects a developing operation from one side of a photosensitive belt 15.

A toner, fed from a toner chamber 18 by the scraping blades 17, is supplied to a developing roll 14 by a reset roll 19. The toner, thus fed to the developing roll 14, is controlled by a control blade 20, and an electrified, thin toner layer is formed on the developing roll 14 through frictional electrification caused by the blade 20. This thin toner layer is pressed against the photosensitive belt 15, thereby effecting the developing. Even with respect to such a non-magnetic one-component developing method, in a construction in which developing machines are arranged above a photosensitive belt, dropping of a toner onto the photosensitive belt can be reduced to a certain level, but not to an acceptable level. This developing method has another problem that that portion near the blade is liable to be clogged by the toner. Also, in a construction in which developing machines are arranged below a photosensitive belt, means for feeding a toner upwardly must be provided, and it is difficult to stably feed the toner to a control blade portion. Thus, even in the non-magnetic one-component developing method, the construction in which the developing machines are arranged on one side of the photosensitive belt in a stacked manner is advantageous.

There are some problems even with the conventional construction in which developing machines are arranged on one side of a photosensitive belt in a stacked manner.

Figure 5:
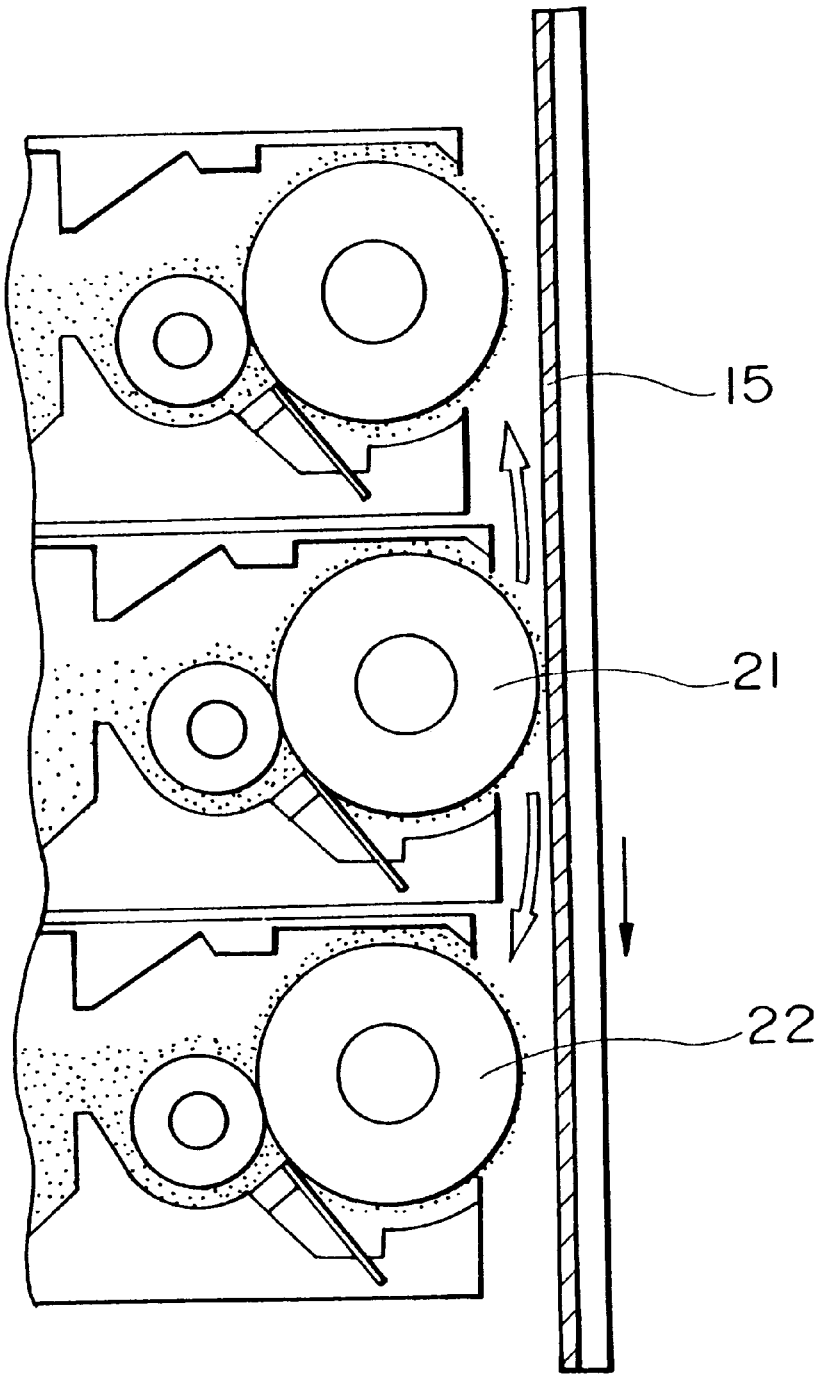
FIG. 5 is a view showing developing machines stacked together on one side of a photosensitive belt.

FIG. 5 shows developing machines stacked together on one side of a photosensitive belt.

The photosensitive belt 15 moves downward (in FIG. 5), and each developing roll rotates in a clockwise direction. In this case, when the elevated developing machines are effecting developing on the photosensitive member, a small amount of a toner is scattered from the developing roll 21 held in contact with the photosensitive belt 15. The scattered toner adheres to a non-image portion of the photosensitive belt 15 to provide fogging, and is included or introduced into the lower color developing machine. Therefore, as the image recording proceeds, the toners of different colors are accumulated in the respective color developing machines, so that the vividness of the color is adversely affected, and besides the electrification of the toner is varied, so that the proper developing can not be maintained. If the photosensitive belt and the developing rolls are rotated in the opposite direction (FIG. 5), the above phenomenon is suppressed to a certain degree, but not to an acceptable level.

Figure 6:
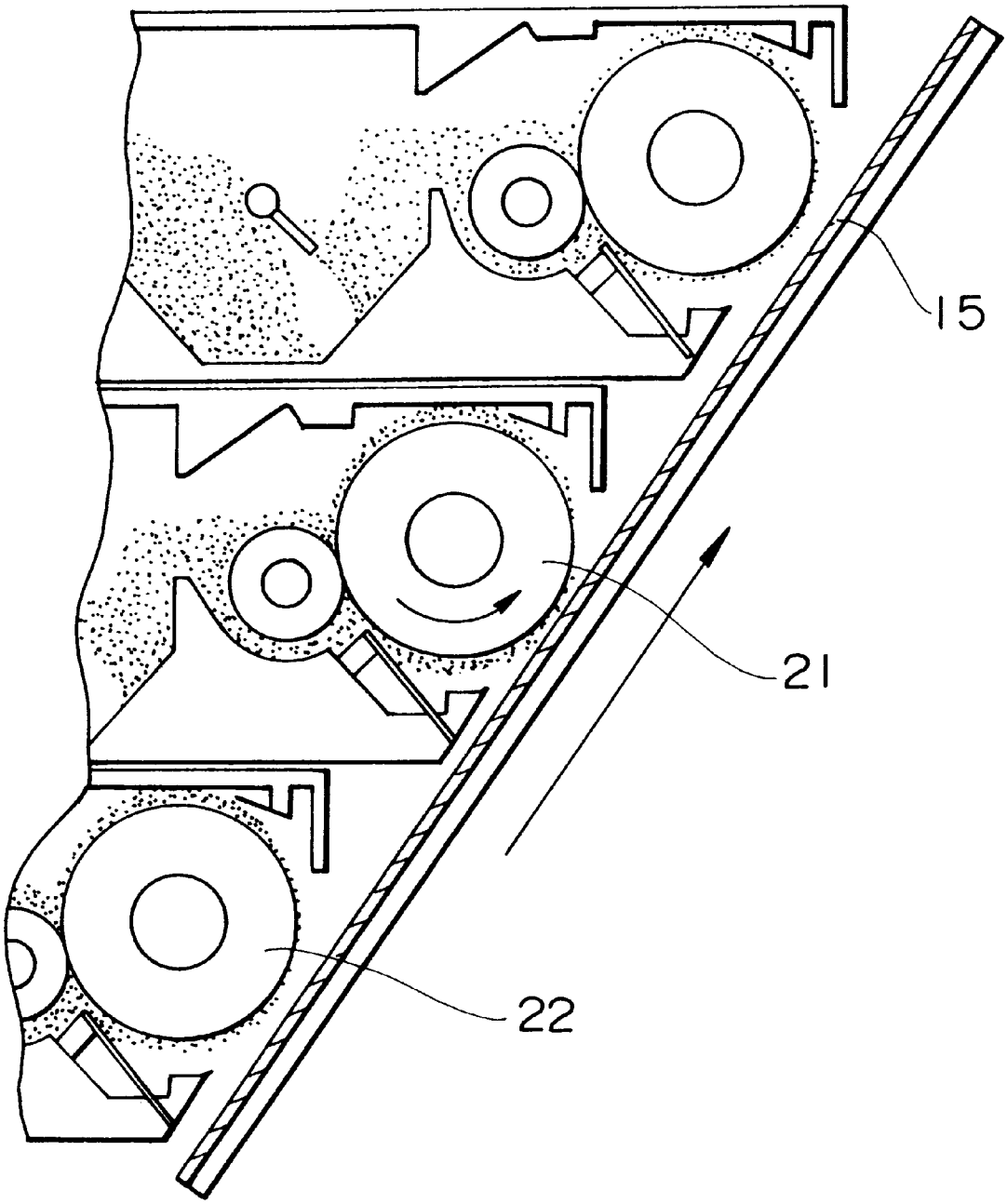
FIG. 6 is a view schematically showing a positional relationship between a photosensitive belt and developing machines in the present invention.

FIG. 6 schematically shows a positional relationship between a photosensitive belt 15 and developing machines in the present invention. In the present invention, that side of the photosensitive belt 15 with which the developing machines are brought into contact is extended obliquely, and moves upward. The developing machines are stacked together, and are offset from one another in accordance with the inclination of the photosensitive belt 15. In this construction, since the developing machines are stacked together in an offset manner, there is no fear that a toner, dropping from a developing roll 21 which is effecting a developing operation, adheres to a lower developing machine developing roll 22. And besides, since the photosensitive belt 15 is moving upward, the toner, dropping onto the photosensitive belt 15, is recovered to the developing roll, which is effecting the developing operation, in accordance with the movement of the photosensitive belt 15. Since the developing machines are arranged in an offset manner, the toner, scattered upwardly from the developing roll which is effecting the developing operation, is intercepted by a lower surface of a box-like housing of the elevated developing machine, and therefore will not be introduced into the elevated developing machine.

If the angle of inclination of that surface of the photosensitive belt 15 about which the developing machines are arranged is too large, a surface portion of the photosensitive belt 15 required for each developing machine is so long that the overall size of the apparatus is increased. Therefore, the angle of inclination of the photosensitive belt 15 is preferably in the range of several degrees to several tens of degrees relative to a vertical plane.

In order that the toner in the developing machine which is effecting the developing operation will not be introduced into the other developing machines disposed vertically in a stacked manner, it is necessary that the adjacent developing machines should be offset in a stepped manner by an amount larger than an amount, by which the developing roll of each developing machine projects. If an amount, by which of the developing roll projects, is about 3 mm, an amount of offset of the developing machines is about 5 mm, taking a tolerance into account, and a pitch of the developing machines is 40 mm, then the angle of inclination of the developing machines facing the photosensitive belt 15 amounts to ATN(5/40)=7.1 degrees.

When the developing machines used in the present invention are of the non-magnetic one-component developing type, the developing machines need to be brought into contact with the photosensitive belt, and it is important that an impact, produced when each developing machine contacts the photosensitive belt, should be small in order to suppress the scattering of the toner. Therefore, it is important that each of the developing rolls should rotate in a direction corresponding to the direction of travel of the photosensitive belt, that is, rotates upwardly at that side thereof facing the photosensitive belt.

In the apparatus of the invention shown in FIG. 1, the intermediate transfer drum is used. Since only the single-color image is formed on the photosensitive belt, as compared with a method in which images are superimposed directly on a photosensitive belt, a method using an intermediate transfer drum is advantageous in that a toner image can be developed without disturbing a precedingly-developed toner image, so that a color image of high quality can be recorded. And besides, the superimposed images of different colors are transferred at a time from the intermediate transfer drum to a paper sheet, and therefore as compared with a method in which images of different colors are superimposed on a paper sheet, a wide variety of paper sheets as well as various paper thicknesses can be used in the above method of the present invention. Furthermore, as compared with a method using a photosensitive belt and an intermediate transfer belt, the intermediate transfer drum is sufficiently rigid, and therefore misregistration is less liable to occur.

In order to further reduce the size of the color electrophotographic apparatus using the intermediate transfer drum of this construction, it is required that the intermediate transfer drum and the photosensitive belt should be reduced in size. In the method using the intermediate transfer drum, a peripheral length of the intermediate transfer drum should be longer than a length of a recording paper sheet in a direction of feed thereof. The peripheral length of the intermediate transfer drum required for feeding a paper sheet of A4-size in its longitudinal direction is not less than 297 mm. If the interval (or distance) between the paper sheets is about 50 mm, the diameter of the intermediate transfer drum should be about 110 mm.

The photosensitive belt is formed by forming a sheet-like photosensitive member into a loop, and then by joining opposite ends of this sheet-like member together by an adhesive or by welding. Therefore, the photosensitive belt has a joint. In order to effect recording while clearing the joint of the photosensitive member, it is necessary that the photosensitive member should contact the same portion of the intermediate transfer drum each time the photosensitive member is rotated, and that the width of the joint is less than the interval between the paper sheets.

As described above, if the interval between the A4-size paper sheets is about 50 mm, and the diameter of the intermediate transfer drum is 110 mm, then the length of the photosensitive belt is 345.4 mm. If this photosensitive belt is extended around two shafts each having a diameter of 20 mm, the length of opposed flat portions of the belt is about 140 mm. If four developing machines are provided, the width of each developing machine is 35~45 mm. Thus, in order to reduce the length of the photosensitive belt so as to achieve a compact design of the apparatus, the very thin developing machines are required. If the photosensitive belt free of joint is used, the length of the photosensitive belt does not always need to be an integral multiple of that of the intermediate transfer drum, but in order to reduce the overall size of the apparatus, it is important that the developing machines should have a thin design.

When a photosensitive belt of a small length is used, the manner of extending the belt is also important in addition to the thin design of the developing machines.

Figure 7:
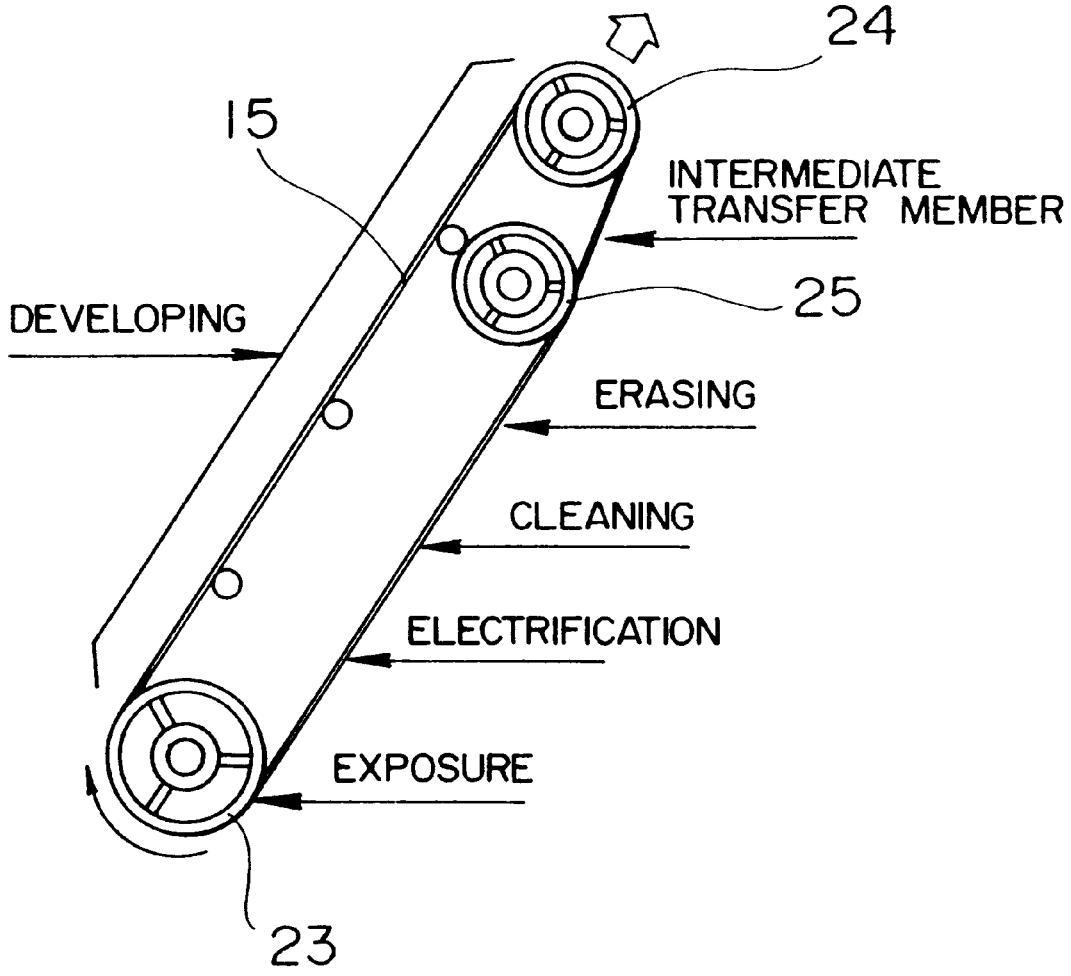
FIG. 7 is a view explanatory of a photosensitive belt unit of the present invention.

FIG. 7 is a view explanatory of the photosensitive belt unit 10 used in the apparatus of the invention shown in FIG. 1. The photosensitive belt 15 is supported by three shafts to provide a large flat surface so as to arrange the developing machines with a simple construction. The three shafts are a drive shaft 23 for driving the photosensitive belt 15, a tension shaft 24 for applying a tension to the belt 15, and a guide shaft 25 for guiding that portion of the belt 15 in contact with the intermediate transfer drum, respectively. It is preferred that the drive shaft for driving the photosensitive belt be a fixed shaft (that is, held in a fixed position), and therefore the tension shaft 24 and the drive shaft 23 are separate from each other. Since the drive shaft 23 is fixed, it is preferred that an exposure position should be provided at that portion of the photosensitive belt 15 around this drive shaft 23.

The tension shaft 24 is provided on a side opposite to that surface of the belt about which the developing machines are provided, and with this arrangement, fluctuation of the belt, produced when the respective developing machines contact the photosensitive belt, is absorbed, thereby preventing such fluctuation from being transmitted to the intermediate transfer drum provided on the reverse side of the belt. Alternatively, the tension shaft 24 may be fixed to support a driven pulley, and the guide shaft 25 may be movable to support a tension pulley. In this case, preferably, the position of contact of the intermediate transfer drum with the photosensitive belt 15 is downstream of the tension pulley, that is, close to the drive shaft. With this arrangement, when switching the developing machines, fluctuation of the belt is absorbed, and therefore is prevented from being transmitted to the intermediate transfer drum.

In order that the toner image can be stably transferred from the photosensitive belt to the intermediate transfer drum, it is necessary that the intermediate transfer drum and the photosensitive belt should stably contact each other. The guide shaft 25 for guiding the photosensitive belt 15 is required for achieving the stable contact between the intermediate transfer drum and the photosensitive belt. In order to efficiently arrange the short photosensitive belt of a short length, it is advantageous that the above three shafts, performing their respective functions, support the photosensitive belt.

Figure 8:
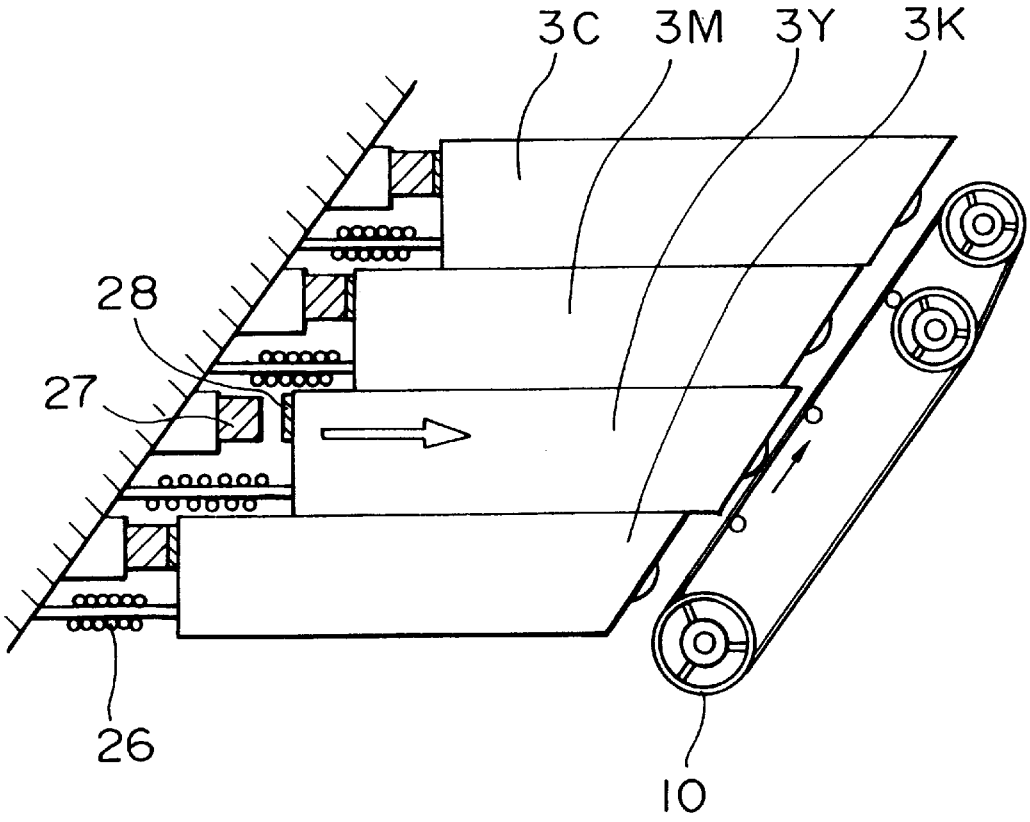
FIG. 8 is a view explanatory of a retracting mechanism of the developing machine of the present invention.

FIG. 8 is a view showing a construction of a retracting mechanism for the developing machines of the invention.

In the color electrophotographic apparatus of the invention shown in FIG. 1, the developing machines of different colors are stacked together on one side of the obliquely-extending photosensitive belt unit 10, and it is necessary to bring each developing machine into and out of contact with the photosensitive belt so as to develop the corresponding color image. Since each developing machine is of a small size, this mechanism should also be of a small size. And besides, in order to prevent damage and deterioration of the photosensitive belt, it is desired that when a main power source is interrupted, the developing machines be moved apart from the photosensitive belt.

The developing machine-retracting mechanism shown in FIG. 8 comprises developing machine-retracting springs 26 for pulling the developing machine away from the photosensitive belt, the developing machine comprising a slide mechanism by which the developing machine can slide toward the photosensitive belt. The spring 26 normally holds the developing roll away from the photosensitive belt. When the developing machine is to be contacted with the photosensitive belt, an electromagnet 27, provided rearwardly of the developing machine, is energized so that the developing machine is moved toward the photosensitive belt by a repulsive force produced by the electromagnet 27 and a permanent magnet 28 mounted on a rear end of the developing machine.

In the construction shown in FIG. 8, the repulsive force of the magnets is utilized, and therefore it is necessary to provide the permanent magnets on the rear end of the developing machine. However, if the electromagnets 27 can be provided on the sides or the front end of the developing machine, the developing machine can be moved toward the photosensitive belt, utilizing an attractive force produced by the electromagnet 27. In this case, a magnetic member of iron or the like which can be attracted by the magnet is merely provided on a relevant portion of the developing machine, and a permanent magnet does not need to be mounted on the developing machine. This arrangement is advantageous over an arrangement, which uses a cam or the like, in that the construction is simplified.

Among mechanisms for cleaning up the residual toner on the photosensitive belt or the intermediate transfer drum, there are a brush cleaning mechanism which involves use of a rotating brush is addition to application of voltage, and a blade cleaning mechanism having a blade which is pressed against the belt or the drum to scrape off the residual toner. The blade cleaning mechanism is free of moving parts to be simple in construction. However, since cleaning is effected by scraping off the residual toner, the surface of the photosensitive belt to be cleaned must be disposed either above the blade cleaner or laterally of the blade cleaner. In the color electrophotographic apparatus of the invention shown in FIG. 1 in which the photosensitive belt is obliquely extended, the photosensitive cleaner 8 can be provided on the lower side of the photosensitive belt, and this construction is advantageous also in this respect.

Reference is now made to a drive mechanism for driving the photosensitive belt and the intermediate transfer drum in the color electrophotographic apparatus of the invention shown in FIG. 1.

Unless the photosensitive belt and the intermediate transfer drum are driven accurately in synchronism with each other, the images of different colors can not be precisely superimposed together. Therefore, it can be proposed to use two pulse motors to control the rotations of the two members with high precision. However, in order to achieve such a control, the motors need to be extremely highly precisely controlled, and also the various parts, including the intermediate transfer drum (e.g., the diameter thereof) and the photosensitive belt, need to have extremely high dimensional accuracies.

Therefore, in this embodiment, the drive mechanism is provided on the photosensitive belt, and the photosensitive belt is held in contact with the intermediate transfer drum to transmit a driving force hereto, thereby driving the intermediate transfer rum. In this method, since a load for the rotation of the intermediate transfer drum must be small, the blade cleaning mechanism (in which the blade is pressed against the drum) is not preferred as the cleaning mechanism for the intermediate transfer drum. Therefore, in the color electrophotographic apparatus of the invention shown in FIG. 1, the intermediate transfer member cleaner 9 having a fur brush is used for cleaning the intermediate transfer drum.

Finally, reference is made to the position of the fixing device 7. The fixing device 7 heats the toner, deposited on the paper to fuse the same. Therefore, the fixing device is liable to exert a thermal influence to the ambient process. Particularly, the developing machine contains the toner not yet developed, and therefore it is possible that the toner in the developing machine is fused under the influence of the heat from the fixing device. Therefore, in the apparatus, it is preferred that the fixing device should be spaced as much as possible from the developing machines. Also, in view of the influence on the other processes in the apparatus, it is preferred that the fixing device should be located at a position as high as possible in the apparatus. In view of these, in the color electrophotographic apparatus of the invention shown in FIG. 1, the fixing device 7 is located at the upper portion of the apparatus, and is disposed on that side of the intermediate transfer drum facing away from the developing machines.

As described above, the color electrophotographic apparatus of FIG. 1, to which the developing machines and the imaging process-effecting portions of the invention are applied, is capable of recording a color image of stable quality in which different colors are not mixed together, and can be reduced in size.

Figure 9:
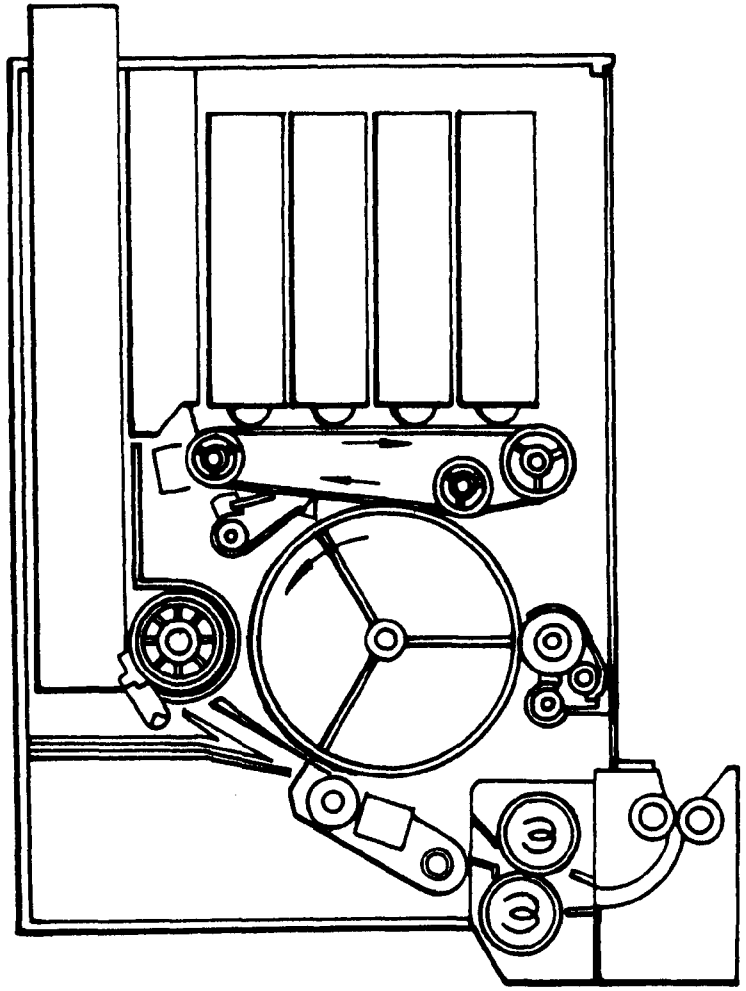
FIG. 9 is a view showing an overall construction of another preferred embodiment of a small-size color electrophotographic apparatus of the present invention.
Figure 10:
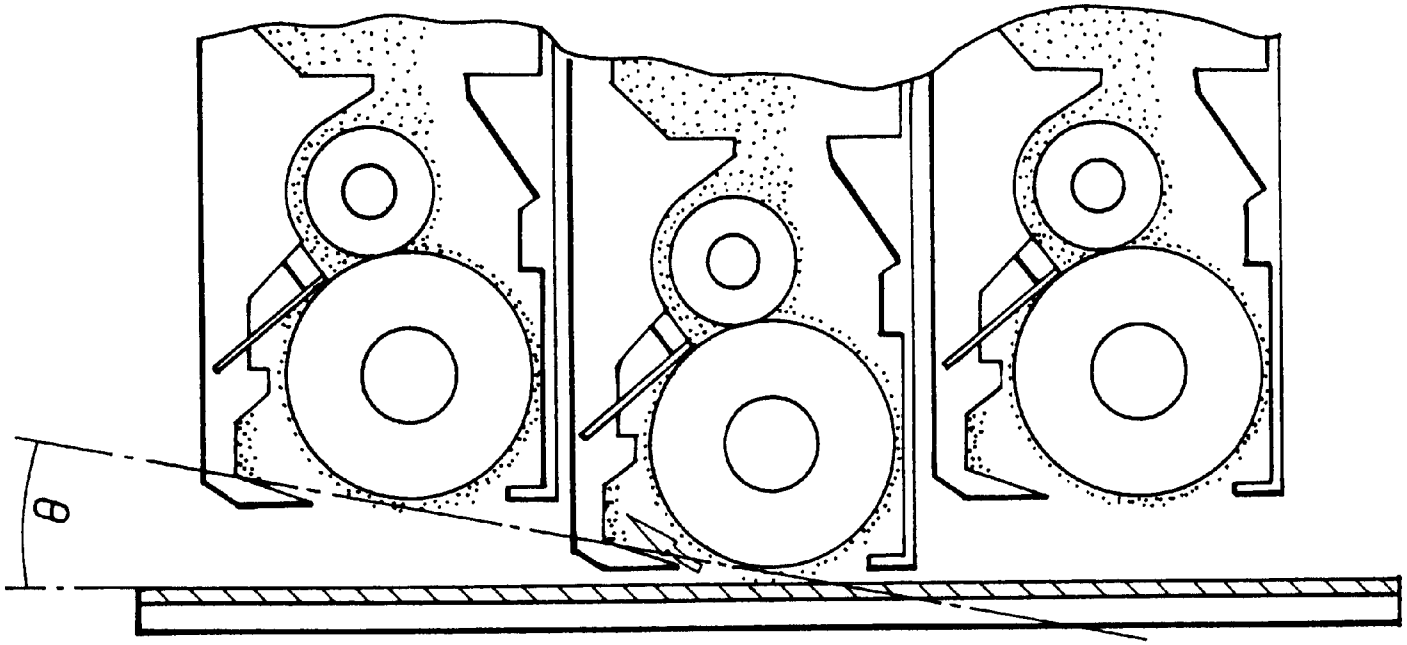
FIG. 10 is a view showing the arrangement of developing machines in the present invention.

FIG. 9 shows another embodiment of an apparatus of the invention which is further reduced in size. In the apparatus of FIG. 9, a photosensitive belt unit is arranged vertically so that this apparatus can be smaller in size than the apparatus of FIG. 1. In this construction, developing of toner images is effected on that surface of the photosensitive belt moving upwardly, and therefore scattering and mixing of toners are suppressed more effectively than the construction in which the developing-effecting surface of the photosensitive belt is moving downwardly. However, since the photosensitive belt is extended vertically, this construction is less advantageous as compared with the embodiment of FIG. 1. However, as shown in FIG. 10, if stand-by (inoperative) developing machines are offset in a stepped manner to an extent larger than that corresponding to the angle of inclination of the photosensitive belt of the preceding embodiment, and if guide members for receiving the scattered toner are provided respectively at upper and lower sides of the developing machine (particularly, it is important to provide such a guide member at the lower side of the developing machine), then the mixing of colors due to the scattered toners can be considerably prevented. The apparatus shown in FIG. 9 is similar in construction to the apparatus shown in FIG. 1 except that the photosensitive belt is arranged vertically, and therefore has similar small-size and safety features as described with respect to the apparatus shown in FIG. 1. By properly making the above arrangement for dealing with the problem of the vertically-extending photosensitive belt, the very small-size, color electrophotographic apparatus can be achieved.

As described above, in the present invention, mixing of different color toners between the developing machines can be suppressed, and therefore there can be provided a color laser beam printer capable of stably recording a color image of a high quality. Furthermore, in the present invention, because of the provision of the photosensitive belt having a reduced length, the imaging process-effecting portions can be efficiently arranged, and therefore there can be achieved the small-size color electrophotographic apparatus.

What is claimed is:

1. A color electrophotographic apparatus comprising a photosensitive belt arranged obliquely, and a plurality of developing machines arranged on one side of said photosensitive belt in a stacked manner so as to be displaced from one another in a horizontal direction, said photosensitive belt being movable from below to above in a direction opposite to a direction of gravity when in a developing position, wherein said developing machines include a non-magnetic, one component contact developing system having a developing roll for adhering toner on said photosensitive belt and a blade disposed below said developing roll for controlling an amount of toner adhering to said developing roll, each of said developing machines including a slide mechanism enabling sliding movement of said developing machine toward said photosensitive belt so as to bring said developing roll into contact with said photosensitive belt for contact developing, whereby due to the movement of said photosensitive belt from below to above and the location of said developing machines at one side of said photosensitive belt in a developing operation, toner which drops onto said photosensitive belt is recovered to said developing roll which is effecting the developing operation.

2. Apparatus according to claim 1, wherein a direction of rotation of said developing roll when in the developing position is from below to above in a direction toward said photosensitive belt and corresponding to the movement direction of said photosensitive belt.

3. Apparatus according to claim 1, wherein said developing machines are adjacent to and face said photosensitive belt at a predetermined angle of inclination.

4. Apparatus according to claim 3, wherein said predetermined angle of inclination is 7.1 degrees.

5. Apparatus according to claim 1, wherein said photosensitive belt is an endless belt arranged obliquely so that said endless belt has an upper side movable from below to above in the direction opposite to the direction of gravity when in a developing position and a lower side movable from above to below in the direction of gravity, said developing machines arranged on said one side of said photosensitive belt being arranged on the upper side of said photosensitive belt.

6. Apparatus according to claim 1, wherein said developing machines having said non-magnetic, one component contact developing system with said developing roll and said blade are arranged on the one side of said photosensitive belt so as to suppress leakage of toner among the developing machines.

7. Apparatus according to claim 1, wherein said developing machines are switchingly operated to successively form different color images on said photosensitive belt for image recording.

8. Apparatus according to claim 7, in which there is provided an intermediate transfer member on which the different colors images, formed on said photosensitive belt respectively by said plurality of developing machines, can be combined together.

9. Apparatus according to claim 8, in which said photosensitive belt includes a first shaft having means for applying a tension to said photosensitive belt, a second shaft for driving said photosensitive belt, and a third shaft for guiding said photosensitive belt.

10. Apparatus according to claim 8, in which a cleaner unit for cleaning said photosensitive belt is provided adjacent to a lower surface of said photosensitive belt facing generally in the direction of the gravity.

11. Apparatus according to claim 10, in which said cleaner unit is a blade cleaner which comprises a blade member adapted to contact with said photosensitive belt so as to scrape off a toner on said photosensitive belt.

12. Apparatus according to claim 8, in which thermal fixing means for fixing the image, transferred to a paper sheet, to said paper sheet, is provided laterally or upwardly on an opposite side of said intermediate transfer member to said photosensitive belt.

* * * * *